US008074697B2

(12) United States Patent
Iglesias Ballester

(10) Patent No.: US 8,074,697 B2
(45) Date of Patent: Dec. 13, 2011

(54) DOUBLE-CURTAIN RAPID-OPENING DOOR

(75) Inventor: Miguel Angel Iglesias Ballester, Barcelona (ES)

(73) Assignee: Amiserru, S.L. (ES)

( * ) Notice: Subject to any disclaimer, the term of this patent is extended or adjusted under 35 U.S.C. 154(b) by 458 days.

(21) Appl. No.: 12/293,650

(22) PCT Filed: Mar. 21, 2006

(86) PCT No.: PCT/ES2006/000138

§ 371 (c)(1), (2), (4) Date: Sep. 19, 2008

(87) PCT Pub. No.: WO2007/107609

PCT Pub. Date: Sep. 27, 2007

(65) Prior Publication Data

US 2010/0212841 A1 Aug. 26, 2010

(51) Int. Cl.

| | |
|---|---|
| ***A47H 5/00*** | (2006.01) |
| ***E06B 3/48*** | (2006.01) |
| ***E06B 3/94*** | (2006.01) |
| ***E06B 9/06*** | (2006.01) |
| ***E06B 9/08*** | (2006.01) |

(52) U.S. Cl. ..... 160/84.06; 160/133

(58) Field of Classification Search ..... 160/113, 160/121.1, 123, 126, 118, 264, 266, 133, 160/170, 188, 193, 310, 349.1, 84.01, 84.03, 160/84.08, 87, 179

See application file for complete search history.

(56) References Cited

U.S. PATENT DOCUMENTS

2007/0193698 A1* 8/2007 Kraeutler ..... 160/36
2008/0099156 A1* 5/2008 Kraeutler ..... 160/84.01

FOREIGN PATENT DOCUMENTS

| | | | |
|---|---|---|---|
| ES | 2150831 | A1 | 12/2000 |
| ES | 1061264 | U | 1/2006 |
| ES | 1061265 | U | 1/2006 |
| FR | 2769944 | A1 | 4/1999 |
| FR | 2861121 | A1 | 4/2005 |
| FR | 2868462 | * | 10/2005 |

OTHER PUBLICATIONS

International Search Report dated Jun. 27, 2006, issued in corresponding international application No. PCT/ES2006/000138.

* cited by examiner

*Primary Examiner* — Katherine Mitchell
*Assistant Examiner* — Jeremy Ramsey
(74) *Attorney, Agent, or Firm* — Ostrolenk Faber LLP

(57) ABSTRACT

The present invention comprises two sheets of canvas fabric or curtains and means for rolling up vertical strips or bands connected to intermediate crosspieces that move along guides when the strips are taken up. The crosspieces have a hollow cross section with an upper ridge and a lower ridge with holes for the strips to pass through. The crosspieces have, on the outer lateral faces, at least one groove for the fastening, by means of a bead, of bands for joining to the adjacent curtain. The inner faces of the crosspiece have one or more rounded longitudinal projections for guiding the displacement strips. The crosspieces comprise shock-proof elastic element arranged on the upper and/or lower ridge.

16 Claims, 6 Drawing Sheets

DOUBLE-CURTAIN RAPID-OPENING DOOR

CROSS REFERENCE TO RELATED APPLICATIONS

The present application is a 35 U.S.C. §371 National Phase conversion of PCT/ES2006/000138, filed Mar. 21, 2006. The PCT International Application was published in the Spanish language.

OBJECT OF THE INVENTION

This present invention refers to a double-curtain rapid opening door, being able to work in unison (to open and close the door) by means of some vertical tapes that cross some internal horizontal cross pieces associated to both curtains.

BACKGROUND TO THE INVENTION

In any number of industrial installations it is necessary for the access doors, both external and equally internal, to make the transit of people and goods easy, guaranteeing quick opening and closing in an automatic manner.

There are a large number of rapid opening doors on the market for this purpose. Generally made up from a canvas or curtain hung at the threshold of the door. In the upper part of said canvas or curtains there are some means of anchoring same to a system that, working with some lifting tapes, allowing the raising and lowering of said canvas or curtain. Said canvas or curtains have a series of horizontal reinforcing crosspieces (or spars) distributed along their length to which different tapes are attached, in such a way that on gathering up said tapes in the rolling up mechanism the gathering up and/or extending out of the canvas or curtain is carried out. Thanks to the lightness of said canvases or curtains the access through these types of doors can be made in a very short time.

DESCRIPTION OF THE INVENTION

The present invention has a series of technical peculiarities that increase the efficiency of the closure, the safety of the door itself, likewise the simplicity of installation and maintenance.

The door has a series of cross pieces made from a profile, which can be hollow section, of any materials, for example, aluminum. The upper and lower ribs of said cross pieces have a series of machinings of greater or lesser size, through which some tapes can move for the gathering up and lifting of the curtain. Said cross pieces, allow the joining of the canvas to said profiles by housing them in the side external faces in a series of grooves and by means of some gaskets or thickenings. Said gaskets or thickenings can have any shape and/or size, thus allowing the curtain to be made in a single piece or in several pieces. These gaskets are extended in some linking strips made from a flexible material for their adhesion to the adjacent curtain, for example by means of heat sealing.

The door has a shock proof elastic element fitted on the upper and/or lower rib of each cross piece, from a material such as rubber or synthetic rubber, foam or something similar. Said shock proof element prevents and/or minimises the noise that can be caused by the cross pieces banging against each other when they are gathered up on the upper part when the door is opened.

The installation of a separator extended laterally on each side of each cross piece has also been planned. Each separator is made from a strip or sheet of a material that has less bend than that of the canvas of the curtain. The separator is fitted in the inner side of said curtain, in such a way that it is suitable to bring about the controlled buckling towards the outside of the curtain, on refolding the door it prevents the folding inwards. In this way when the cross pieces get closer to each other if on opening the door, the separator pushes the fragment of adjacent canvas outwards in a controlled manner, making the folding in a homogeneous manner, with less damage to the canvas and taking up less space.

For the holding of this separator the cross piece has a 'T' shaped groove into which the edge of said separator is housed, which also has a similar 'T' shaped shape. This separator is placed opposite to the groove in which the linking band is fixed.

The last cross piece arranged on the lower part of the threshold has two grooves for the fixing of the adjacent curtain by means of two joining strips, making a permanent loop or fold to each side, which is used for the inner closure.

There are some flexible flanges housed in the ends of each cross piece, which are fixed in the inner hollow of said cross pieces by means of bolts, rivets or some other similar means. Said flanges allow the door to be able to exit from the ridge of the guide in the event of impact against one of the curtains without them getting torn. Some bearings or other pieces can be housed in the end of said flanges for the guiding of the door in the ridge of the lateral guide.

In the upper part of the door there are some more or less flexible elements that are parallel to the strips and located in the external area of the curtains, where the cross pieces are gathered when the door is open. In the event of the door not being guided well for the folding these elements allow the flanges of the cross pieces to return to their correct working position by the inside of the guides.

It has been planned that the cross piece can be made up of two lateral profiles joined longitudinally by some intermediate spacers that define some gaps for the passage of the lifting strips. In addition, these lateral profiles allow the construction of cross pieces of any length by means of alternate arrangement.

It has also been planned that said cross pieces are made from a flexible material with a ridge of a material on the inside to give greater rigidity, which gives the required resistance.

DESCRIPTION OF THE FIGURES

In order to complete the description that is being made and for the purpose of providing a better understanding of its characteristics, a set of drawings is attached to this present description in which the figures being by way of illustration and are not by way of limitation on the invention, in which the following is shown.

PREFERRED EMBODIMENT OF THE INVENTION

Figure 1:
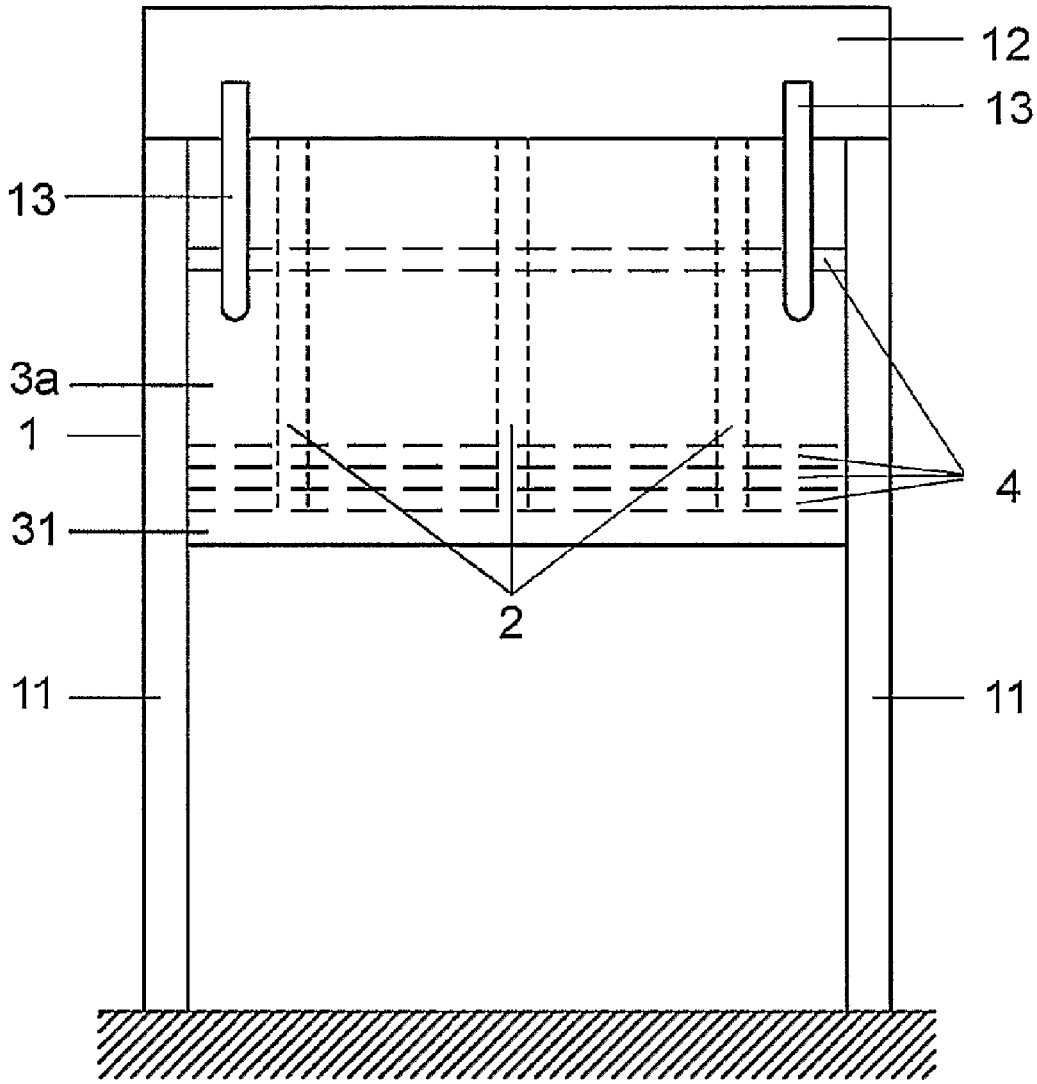
FIG. 1 shows a front view of the door.
Figure 2:
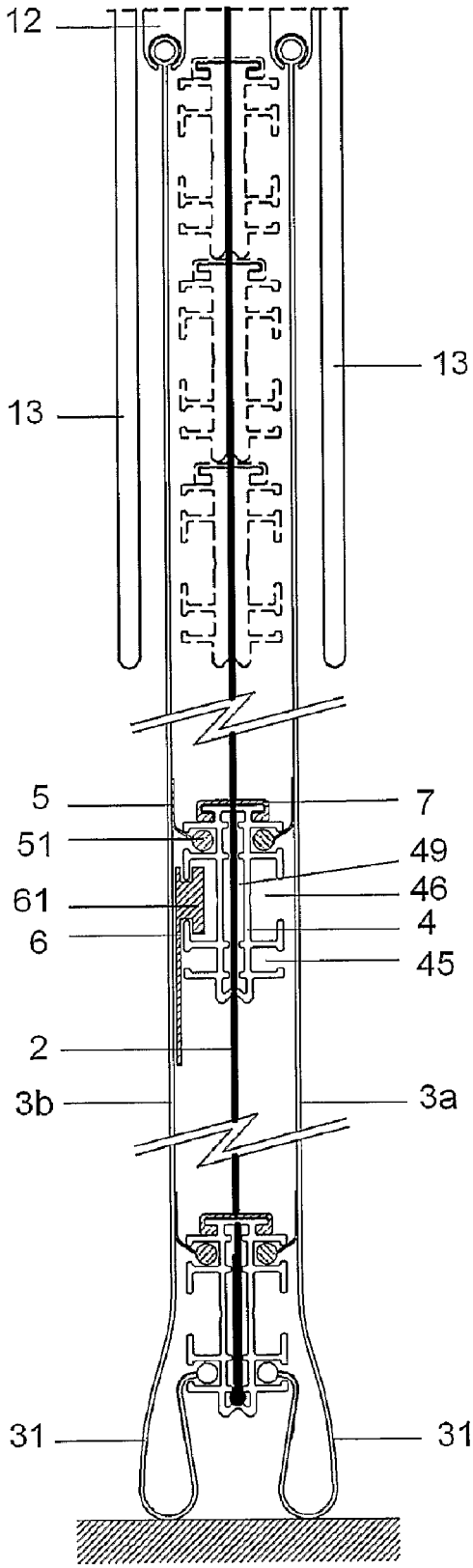
FIG. 2 shows a profile view of the door that has been longitudinally sectioned.
Figure 3:
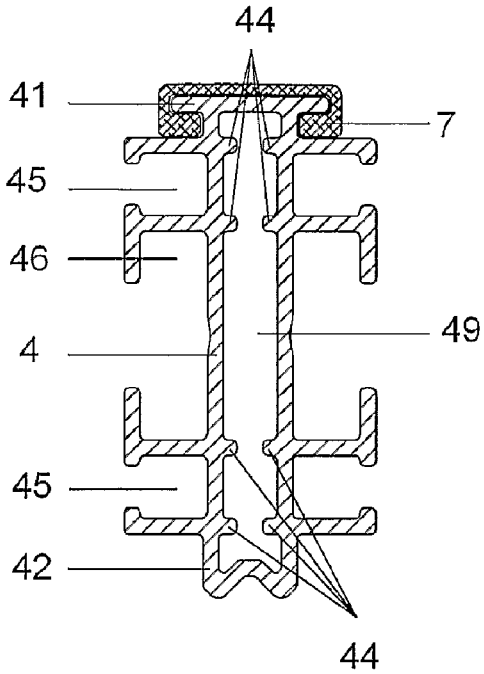
FIG. 3 shows a general section of the cross piece with the assembly of the shock-proof element.
Figure 4:
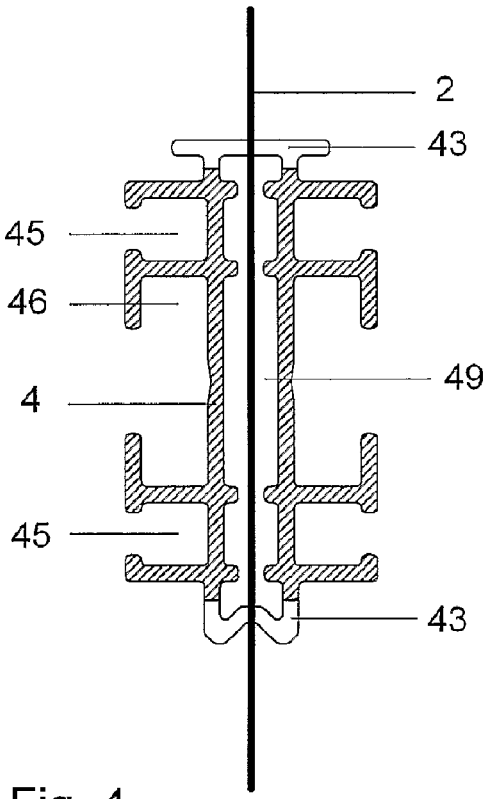
FIG. 4 shows a detail of the section of the cross piece at the area where the strip passes.
Figure 5:
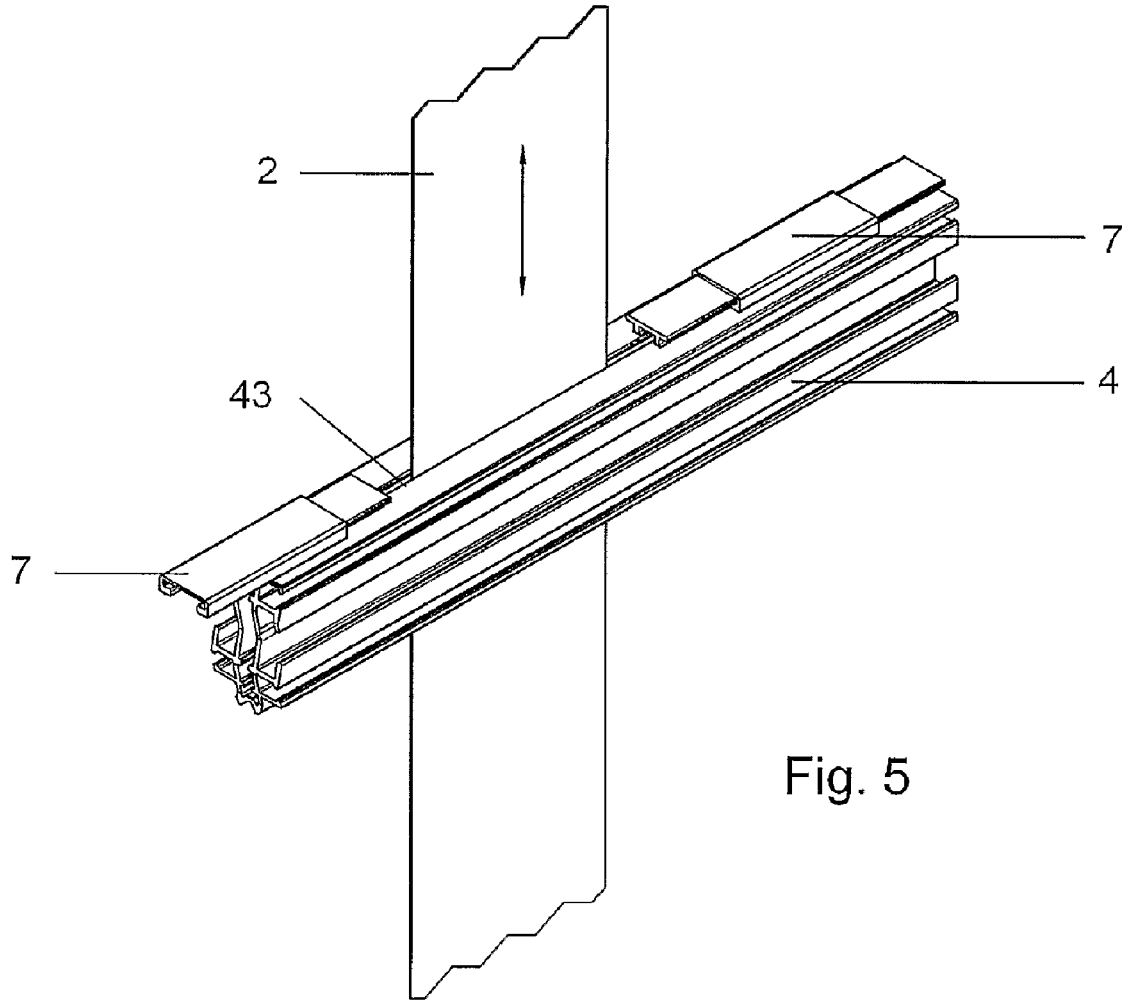
FIG. 5 shows a detail in perspective of the cross piece at the area where the strip passes.
Figure 6:
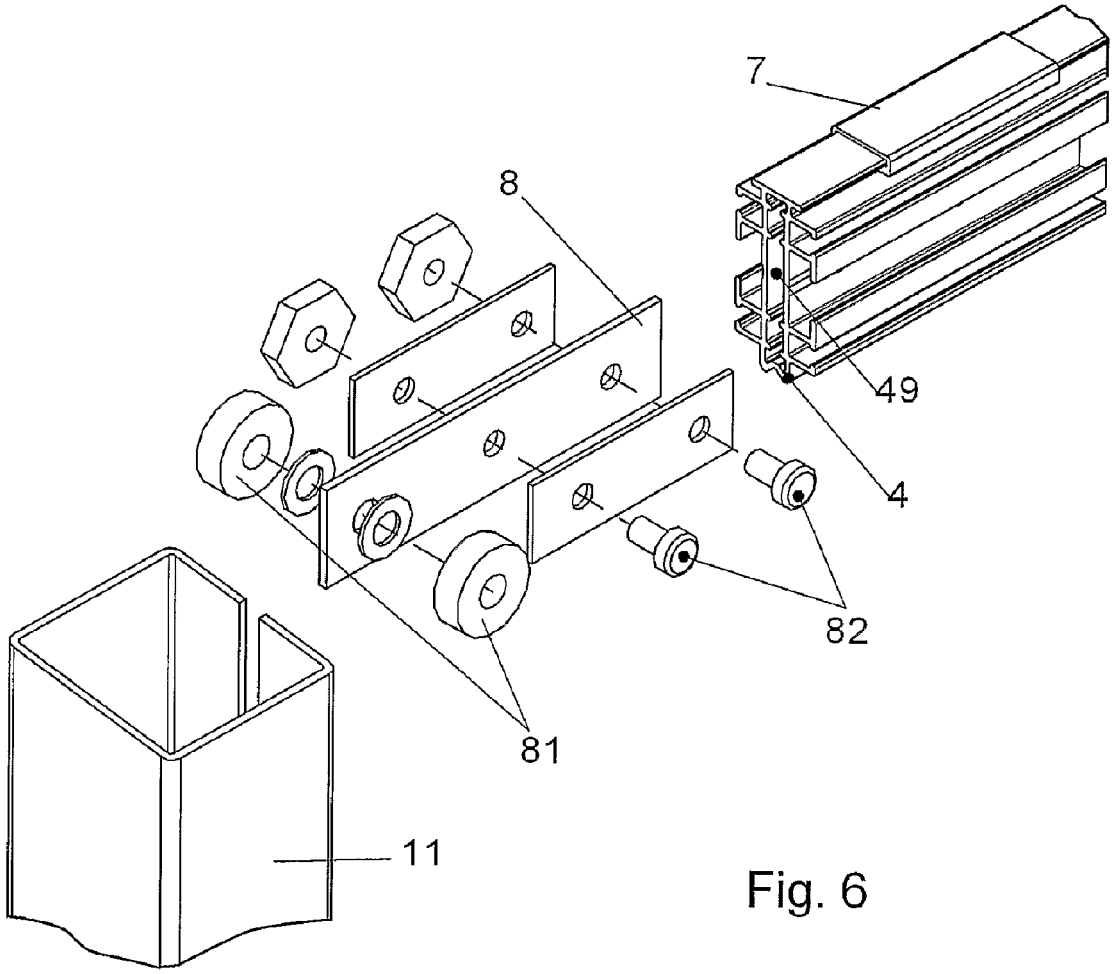
FIG. 6 shows a perspective view of the assembly of the guide flange by the guide cross piece.
Figure 7:
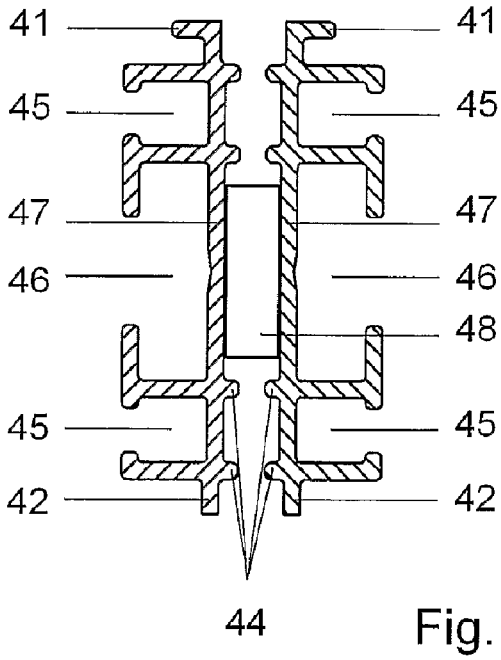
FIG. 7 shows a sectioned detail of a cross piece made from two profiles.
Figure 8:
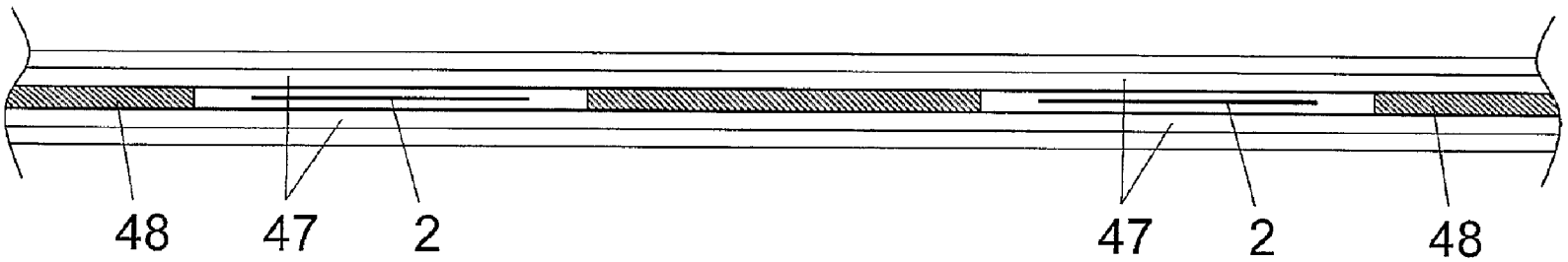
FIG. 8 shows a detail of a plan view of a cross piece made from a plurality of alternating profiles.

As can be seen from the referred to figures, the door has two guides (11) in the shape of a 'C' arranged in the vertical transoms of the threshold to be closed (1), some means of rolling (12) of door movement strips (2) being in the upper part of said threshold (1). The threshold (1) has respective curtains (3*a* and 3*b*) hung down to the floor, by preference made of a flexible plastic material, on both sides of the stated strips (2).

A certain number of cross pieces (4) are distributed between the curtains (3*a* & 3*b*) that are respectively joined to each curtain (3*a* & 3*b*) by means of some longitudinal joining strips (5), the strips (2) being arranged along the inside of said cross pieces (4).

At the upper part of the threshold (1) there are some more or less flexible elements (13) parallel to the strips (2) and located in the external area of the curtains (3*a* & 3*b*) that allow the centering of the cross pieces when the door opens when they are not properly housed in the guides (11).

Each cross piece (4) is made up of a hollow profile, preferably aluminum, which has an upper ridge (41) and a lower ridge (42). These cross pieces (4) have some openings (43) made by machining said ridges (41 & 42) in the areas where the strips (2) have to pass. The cross pieces (4) have several rounded longitudinal openings (44) for the guiding of the movement strips (2) on their inner side faces.

On the external side faces there are two longitudinal support grooves (45) for the connection strips (5) and a 'T' shape groove (46) to support a separator (6). In the upper ridge (41) of the cross piece (4) there is a longitudinal elastic shock-proof element (7) locatable along the whole length of same except for the openings (43), to prevent the noise of knocks between the cross pieces (4).

In each end of the cross pieces (4) there is a flange (8), located in the inner hole (49), with rollers (81) that travel along the ridge of the vertical guides (11). This flange (8) is partially housed on the inside of the crosspiece (4) and is fixed to same by means of screws (82) and some plates.

The joining strips (5) are arranged along the adjacent cross piece (4) and are held by means of a gasket (51) or something similar housed in one of the two grooves (45), preferably the upper one. In turn the strip (5) is bonded with the adjacent curtain (3*a* & 3*b*) by means of heat sealing, a small portion remaining free in order to give flexibility.

In turn, the separators (6) are made from a material with less flexion than the canva of the curtain (3*a* & 3*b*), held by a hem (61) made with a 'T' shape in the groove (46) of a side cross piece (4). This separator (6) is extended vertically against the curtain (3*a* & 3*b*) and in opposition to the gasket (51) of the adjacent linking strip (5).

The cross piece (4) fitted in the lower part of the threshold (1) has a loop (31) made from a portion of the curtain (3*a* & 3*b*) on each side and joined by means of two joining strips (5), respectively fixed in both grooves (45) of both sides of the cross piece (4), with this loop (31) having the feature of bring about the closure with the floor.

In an alternative embodiment, the cross piece (4) is made from two side profiles (47) joined longitudinally by some intermediate spacers (48). These spacers (48) are arranged in such a way that some holes remain between them for the passage of the lifting strips (2). If the cross piece (4) has a considerable length it can be made by means of the union of differing side profiles (47) arranged alternatively.

Once having sufficiently described the nature of the invention, likewise having given a preferred embodiment it is placed on record that the materials, shape, size and arrangement of the elements described can be modified provided that they do not mean an alteration of the basic essentials of the invention that are claimed below.

What is claimed is:

1. A double curtain rapid opening door, of the type that is made from two continuous canvases or curtains hung at a threshold of the door, an upper part of the threshold of the door having some means of rolling of some strips or vertical bands connected to some intermediary cross pieces distributed along inner faces of both curtains and jointly connected for the vertical gathering up of said curtains by means of the movement of the cross pieces along guides located in both sides of the threshold gathering up the strips wherein the cross pieces have an internal hollow section or hollow with an upper ridge and a lower ridge into which a plurality of openings are made and which are machined for the passage of the strips, wherein the inner faces of the cross piece having integral therewith one or more rounded longitudinal opposed protrusions for the guiding of the strips that reduce the surface of rubbing and separate the strips of the machined openings, said double curtain rapid opening door comprising union strips fixed to different areas of the inner faces of the curtains and with some gaskets at free edges of the union strips and each external side face of each cross piece having at least one groove for fixing, by means of a gasket or thickening, of respective free ends of some union strips to the adjacent curtain, and at least one separator on each lateral of the cross piece, this separator being vertically extended, being made from a band or sheet of a material with less flexion than the curtain and arranged on the inner side of said curtain, operationally suitable to bend towards an outside of the curtain in a controlled manner when the door is gathered up, said cross piece in turn having a 'T' shaped groove on each side for the fixing of the separator by a side hem of said separator also having a similar 'T' shape; and at least one separator on each lateral of the cross piece, this separator being vertically extended, being made from a band or sheet of a material with less flexion than the curtain and arranged on the inner side of said curtain, operationally suitable to bend towards an outside of the curtain in a controlled manner when the door is gathered up, said cross piece in turn having a 'T' shaped groove on each side for the fixing of the separator by a side hem of said separator also having a similar 'T' shape.

2. A door according to claim 1 further comprising a longitudinal elastic shock proof element fitted on an upper and/or lower ridge of the cross pieces to prevent noise caused by a knocking of different cross pieces against each other when the door is gathered up.

3. A door according to claim 1, further comprising flexible flanges flexible for the movement in a centre of the guide, each flange being fixed in the inside of the hollow of the cross piece by means of screws or rivets said flanges enabling the door to be able to exit the centre of the guide in the event of impact against one of the curtains.

4. A door according to claim 1, further comprising flexible elements flexible parallel to the strips and located in an external area of the curtains in an upper part where the cross pieces are grouped together when the door is open, which in the event of the door not being well guided makes the cross pieces go back to their correct working position along the inside of the guides.

5. A door according to claim 1, wherein the cross piece further comprises two grooves on each side for the holding of the adjacent curtain by means of two linking strips in a permanent loop next to a lower part of the threshold acting as a lower closure.

6. A door according to claim 1, further comprising flexible flanges flexible for their movement in the ridge of the guide having some bearings in order to reinforce the guiding of the cross pieces that support the curtains against the action of the wind.

7. A door according to claim 1, wherein a separator is extended in an opposite direction to an adjacent union strip compared to the cross piece in which it is fixed.

8. A door according to claim 1, wherein the union strips are made from a flexible material for their adhesion to an adjacent curtain.

9. A door according to claim 1, wherein the cross piece is made from two lateral profiles joined longitudinally by some intermediary spacers that make the spaces for the passage of lifting strips.

10. A door according to claim 1, wherein the cross piece is made from a plurality of lateral profiles arranged alternatively and joined by intermediate spacers to achieve a length required.

11. A door according to claim 1 wherein the cross pieces are made from a flexible material with a material on the inside to make them more rigid on the inside so as to give required resistance.

12. A door according to claim 3, further comprising flexible elements flexible parallel to the strips and located in the external area of the curtains in the upper part where the cross pieces are grouped together when the door is open, which in the event of the door not being well guided makes the cross pieces go back to their correct working position along the inside of the guides.

13. A door according to claim 1, wherein the cross piece has two grooves on each side for the holding of the adjacent curtain by means of two linking strips in a permanent loop next to the lower part of the threshold acting as a lower closure.

14. A door according claim 3, wherein the flexible flanges have some bearings in order to reinforce the guiding of the cross pieces that support the curtains against the action of the wind.

15. A door according to claim 1, wherein the separator is extended in the opposite direction to the adjacent union strip compared to the cross piece in which it is fixed.

16. A door according to claim 9 wherein the cross piece is made from a plurality of lateral profiles arranged alternatively and joined by intermediate spacers to achieve the length required.

* * * * *